US006792906B2

(12) United States Patent
Grant

(10) Patent No.: US 6,792,906 B2
(45) Date of Patent: Sep. 21, 2004

(54) ANTI-STAIN INTAKE MANIFOLD AND FILL NECK FOR INTERNAL COMBUSTION ENGINE

(76) Inventor: Barry S. Grant, Rte. 1, Box 1900, Dahlonega, GA (US) 30533

( * ) Notice: Subject to any disclaimer, the term of this patent is extended or adjusted under 35 U.S.C. 154(b) by 0 days.

(21) Appl. No.: 10/651,060

(22) Filed: Aug. 28, 2003

(65) Prior Publication Data

US 2004/0040528 A1 Mar. 4, 2004

Related U.S. Application Data

(60) Provisional application No. 60/406,902, filed on Aug. 29, 2002.

(51) Int. Cl.[7] ..... B65D 51/16
(52) U.S. Cl. ..... 123/184.21; 123/41.15
(58) Field of Search ..... 123/184.21–184.61, 123/41.15

(56) References Cited

U.S. PATENT DOCUMENTS 4,147,273 A * 4/1979 Malacheski et al. ... 220/203.24
4,836,168 A * 6/1989 Polster et al. ..... 123/41.5
4,922,999 A * 5/1990 Stokes et al. ..... 165/286
5,992,481 A * 11/1999 Smith ..... 141/326
6,053,132 A * 4/2000 Evans ..... 123/41.5
6,216,646 B1 * 4/2001 Smith et al. ..... 123/41.54
6,230,669 B1 * 5/2001 Evans ..... 123/41.5

* cited by examiner

*Primary Examiner*—Marguerite McMahon
(74) *Attorney, Agent, or Firm*—Thomas, Kayden, Horstemeyer & Risley

(57) ABSTRACT

Water fill neck (16) is mounted on the intake manifold (14) of an internal combustion engine. The manifold includes an upstanding collar (22) that surrounds the lower support platform (57) of mounting body (55) of the water fill neck, and liquid accumulation spaces (50–53) are formed within collar (22) and about the lower support platform (57) of the water fill neck. The overflow from the water fill opening (18) past the gasket (37) will be retained beneath the outward projecting rim (60) of the water fill neck, thereby reducing the likelihood of liquid overflow onto the surfaces of the engine.

11 Claims, 3 Drawing Sheets

ANTI-STAIN INTAKE MANIFOLD AND FILL NECK FOR INTERNAL COMBUSTION ENGINE

CROSS REFERENCE

Applicant claims the benefit of U.S. Provisional Patent Application No. 60/406,902 filed in the U.S. Patent and Trademark Office on Aug. 29, 2002.

FIELD OF THE INVENTION

This invention involves a fill neck for the intake manifold of a combustion engine of an automobile or other self propelled vehicle. The manifold and fill neck are configured to avoid leakage of liquid onto the surfaces of the manifold and onto other components in the engine compartment of the vehicle.

BACKGROUND OF THE INVENTION

Car enthusiasts typically enjoy having an engine compartment that is clean and shiny, with the components within the engine compartment well designed with a "streamlined" and organized appearance. At car shows it is common that the engine hood will be raised so that others can observe the type and quality of equipment in the engine compartment.

One of the problems in maintaining the bright and clean appearance of the components in the engine compartment of a functioning automobile is that water that has antifreeze and other additives in it, herein after referred to a "liquid," is inadvertently emitted from about the fill neck of the intake manifold and contacts adjacent surfaces, most of which are hot, and the liquid evaporates, leaving liquid stains on the surfaces. In some instances, the liquid leakage from the manifold is emitted about and through the gasket that is positioned between the fill neck and the intake manifold. Leakage through the gasket is caused by the repeated heating and cooling of the gasket and its adjacent components, by vibration, and by other normal wear conditions. Typically, the amount of liquid emitted about the gasket is small, possibly only a few fluid ounces, but the liquid tends to move under the influence of gravity and under the influence of turbulent air about the engine into contact with the exterior of the intake manifold, onto the engine, and onto the adjacent components, many of which are decorative components or decorative shields about the components. The evaporation of the liquid leaves liquid stains that are randomly distributed about the components of the engine, and which require removal by the car enthusiast when showing the car.

It is to the solution of the above-identified problem that this invention is directed.

SUMMARY OF THE INVENTION

Briefly described, the present invention comprises an intake manifold for an internal combustion engine that is configured to avoid liquid staining of the engine components due to minor leakage from the liquid inlet opening of the intake manifold.

An upwardly facing collar is formed on the upper surface of the intake manifold about the liquid inlet opening of the manifold, forming a well that surrounds the liquid inlet opening. The fill neck is mounted in the well, inside the collar, and the fill neck is configured so as to leave space inside the collar for the accumulation of small amounts of liquid that might be emitted from the intersection of the fill neck and the intake manifold. The collar that forms the well about the liquid inlet opening contains the leaked liquid, and the heat emitted by the operation of the engine tends to rapidly evaporate the liquid from the well, thereby avoiding dripping or splashing of liquid in the engine compartment.

Typically, a gasket is positioned between the fill neck and the liquid intake of the fuel intake manifold, assisting in the sealing between the fill neck and the liquid intake of the manifold. However, due to continual heating and cooling of the gasket, vibration and other normal wear conditions, there is some likelihood of minor leakage through and about the gasket, causing small amounts of liquid to leak into the well formed by the collar. Therefore, even when a gasket is used to retard leakage between the fill neck and the liquid intake of the manifold, there is some possibility of minor leakage and the configuration of the fill neck and the liquid intake of the manifold as herein described avoids the undesirable liquid stains that might otherwise be caused by such leakage.

Therefore, it is an object of this invention to provide an improved fill neck and liquid inlet of a fuel intake manifold that avoids inadvertent liquid stains about the components of an engine compartment of an internal combustion engine.

Another object of this invention is to provide a liquid accumulation well about the fill neck of a manifold that accumulates liquid inadvertently leaked between the fill neck and the liquid inlet of the manifold, so that the liquid can be dissipated due to normal evaporation prior to the liquid being leaked onto other components of the engine.

Another object of this invention is to provide a fuel delivery manifold for an internal combustion engine that is configured to reduce liquid staining of the components of the engine.

Other objects, features and advantages of the present invention will become apparent upon reading the following specification when taken in conjunction with the accompanying drawings.

DETAILED DESCRIPTION

Figure 1:
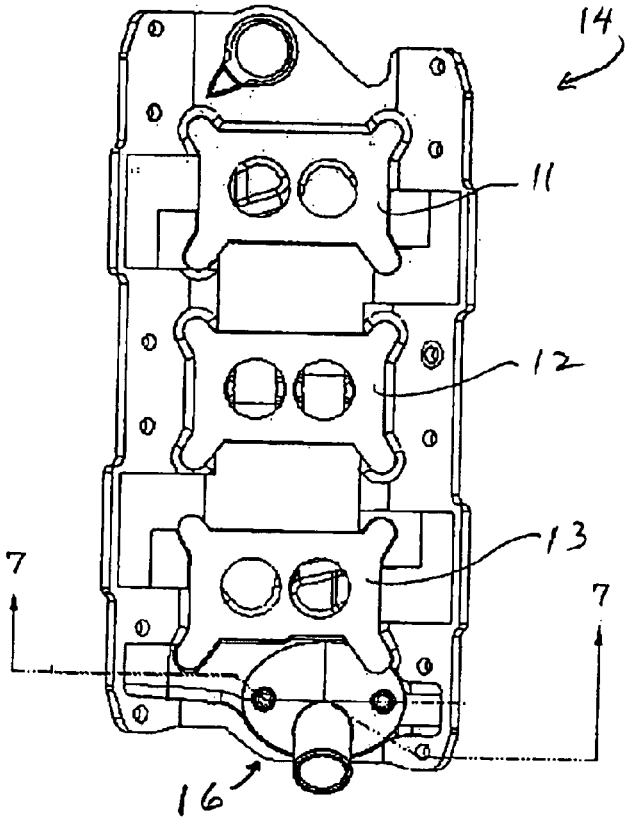
FIG. 1 is a plan view of an inlet manifold for a high performance internal combustion engine of the type that includes three carburetors, showing the fill neck installed thereon.

Referring now in more detail to the drawings in which like numerals indicate like parts throughout the several views, FIG. 1 illustrates the intake manifold 14 of a high performance internal combustion engine. The manifold includes three carburetor platforms 11, 12 and 13, and water fill neck 16 at one end of the manifold 14. The manifold and fill neck are mounted on the engine (not shown) of the vehicle.

Figure 2:
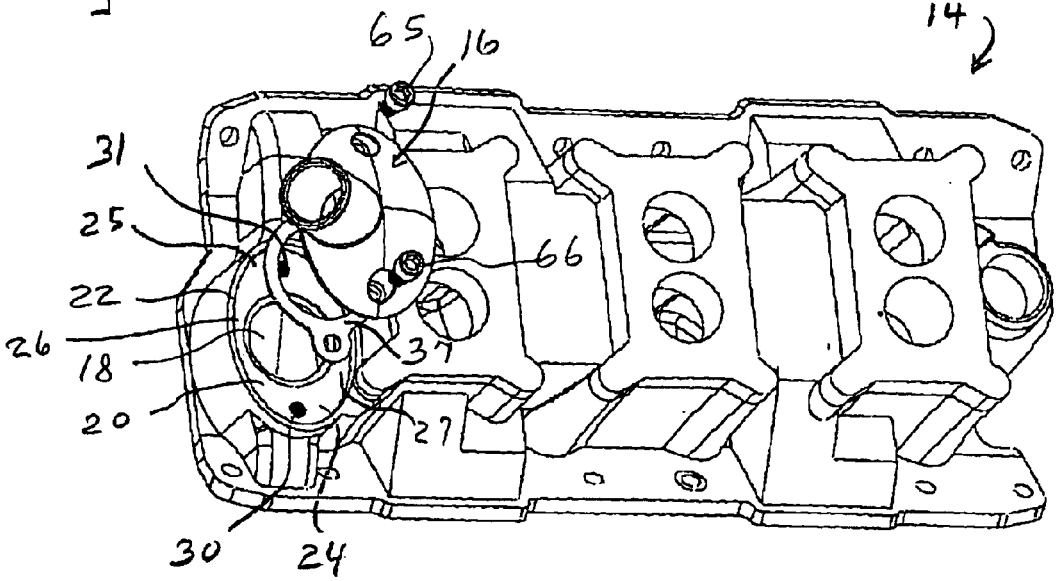
FIG. 2 is a perspective view thereof, showing the fill neck expanded away from the manifold, and exposing the gasket between the fill neck and the manifold, and the bearing surface about the water inlet opening and the collar that surrounds the bearing surface.
Figure 3:
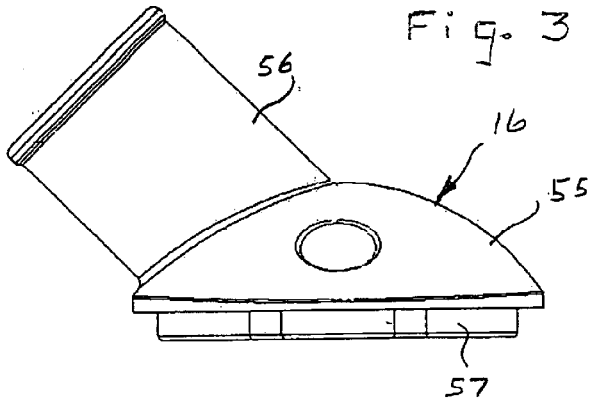
FIG. 3 is a side elevational view of the fill neck.
Figure 4:
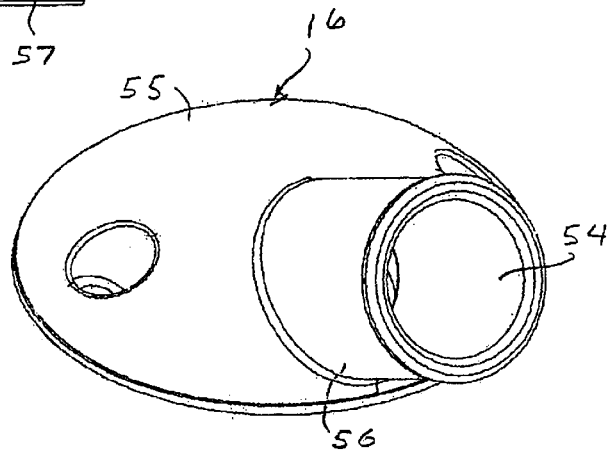
FIG. 4 is a perspective view of the fill neck.
Figure 5:
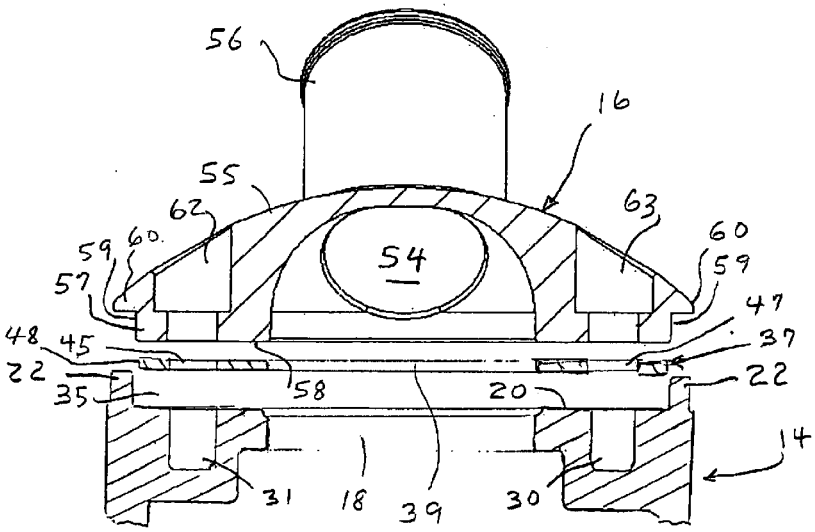
FIG. 5 is a cross-sectional view of the fill neck.

As shown in FIG. 2, the intake manifold 14 includes a water fill opening 18 and a bearing surface 20 surrounding the fill opening 18. An upstanding collar 22 surrounds the bearing surface. The bearing surface and its collar are oval shaped, and are oriented substantially horizontally. The oval shaped bearing surface 20 has side areas 24 and 25 that are larger than the fore and aft areas 26 and 27.

Internally threaded connector bores 30 and 31 are formed downwardly through the bearing surface at the side areas 24 and 25.

The arrangement of the intake manifold at the water fill opening is such that the upwardly extending collar 22 forms a well 35 that surrounds the water fill opening 18, with the oval collar being substantially upright and forming a space that functions as a reservoir for inadvertent overflow of liquid from the water fill opening 18.

Gasket 37 (FIGS. 2 and 5–7) is sized and shaped to fit against the bearing surface 20, to surround liquid opening 18. The gasket has a central opening 39 that is aligned with the liquid inlet opening 18, and side lobes 41 and 43 that project into the side areas 24 and 25 of the bearing surface 20 of the intake manifold, with connector openings 45 and 47 formed in the side lobes. The connector openings 45 and 47 are sized and shaped and spaced apart so as to coincide with the size, shape and spacing of the internally threaded connector bores 30 and 31.

It will be noted that the outer edge 48 (FIG. 6) of gasket 37 is of a different configuration than the bearing surface 20 and the inner boundaries of collar 22. This leaves liquid accumulation spaces 50 and 51 that straddle side lobe 41 of the gasket 37, and liquid accumulation spaces 52 and 53 that straddle side lobe 43 of the gasket.

Fill neck 16 includes a mounting body 55 and neck 56, with a water passage 54 extending there through. Mounting body 55 has a convex, substantially dome shaped, upper surface and a lower support platform 57 that engages gasket 37 and is supported by bearing surface 20 of the intake manifold. The lower support platform 57 includes a substantially flat bottom engagement surface 58 (FIG. 5) that is formed with the same footprint of gasket 37 and bears flat against the gasket. An outwardly facing surface 59 of the lower support platform 57 and laterly extending rim 60 of the lower support platform 57 face the collar 22 of the intake manifold.

Figure 6:
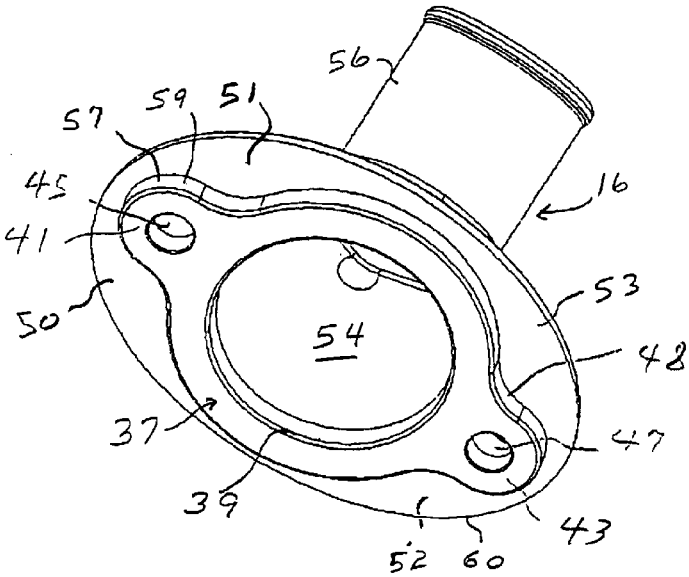
FIG. 6 is a bottom perspective view of the fill neck.
Figure 7:
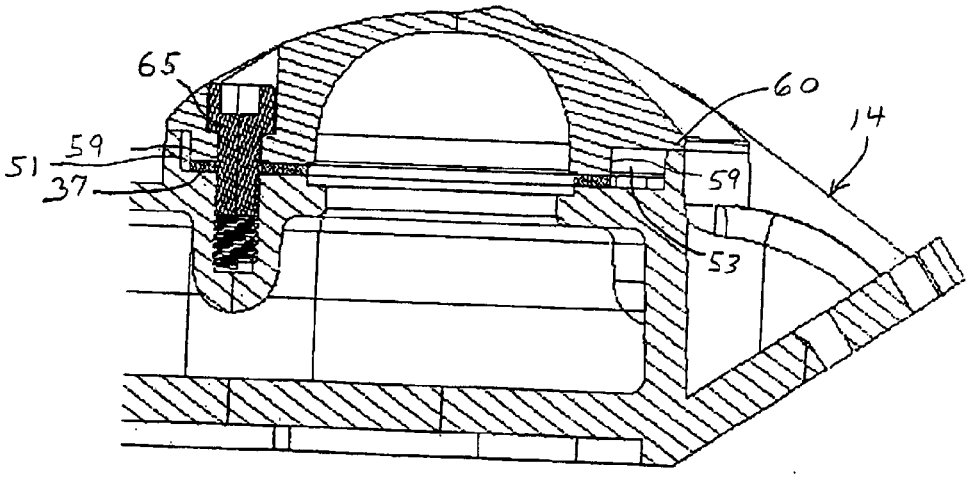
FIG. 7 is a side cross-sectional view of a portion of the intake manifold and the mounting body of the fill neck, taken along lines 7—7 of FIG. 1, showing how the mounting body is attached to the manifold.

As shown in FIG. 6, the liquid accumulation spaces 50–53 also straddle the lower support platform 57. The lower support platform 57 and gasket 37 are received telescopically downwardly inside of the collar 22 of the intake manifold 14, and overhanging rim 60 projects over the collar 22. The rim 60 is shaped so that it is substantially coextensive with the outside surface of the collar 22.

Connector bores 62 and 63 are formed through the mounting body 55 of fill neck 16 and are aligned with the connector openings 45 and 47 of gasket 37 and with the internally threaded connector bores 30 and 31 of the liquid intake manifold 14. Connector screws 65 and 66 are inserted downwardly through the connector bores 62 and 63, connector openings 45 and 47, and are threaded into the internally threaded connector bores 30 and 31 to hold the fill neck 16 in a compressive relationship against gasket 37 and against the bearing surface 20 of the intake manifold 14.

When assembled in this manner, the accumulation spaces 50–53 that surround the lower support platform 57 and gasket 37, and that straddle the side lobes 41 and 43 of the gasket and lower support platform 57 are available in the well 35 of the intake manifold 14, inside collar 22, to collect any coolant that might be emitted from the liquid intake manifold 14 through its water fill opening 18. Collar 22 surrounds the well 35 so as to confine the liquid to prohibit the liquid from dripping onto the surfaces of the intake manifold and other components in the engine compartment of the vehicle.

Thus, liquid accumulation spaces 50–53 provide a reservoir for the water emitted from the intake manifold past the gasket 37.

It will be noted that the outwardly projecting rim 60 of the mounting block 55 of the water fill neck 16 tends to deflect any liquid that might spurt past the gasket, tending to retain the spray of liquid in the reservoir.

In the meantime, when the vehicle is operated and the engine warms up, the heat in the engine compartment, particularly about the radiator area, will increase the temperature of the liquid in the well 35, so that the liquid tends to evaporate rapidly without escaping the well. This reduces the likelihood that the liquid escaping from the radiator will form stains from the liquid coolant emitted from the radiator.

While the manifold 14 illustrated has three carburetor platforms 11, 12 and 13, the manifold can have one or more carburetor platforms. Also, the neck 56 of the water fill neck 16 can be produced so that it extends at other angles from the mounting body, including to the right or to the left of the centerline of the vehicle.

Although a preferred embodiment of the invention has been disclosed in detail herein, it will be obvious to those skilled in the art that variations and modifications of the disclosed embodiment can be made without departing from the spirit and scope of the invention as set forth in the following claims.

I claim:

1. An intake manifold and fill neck for an internal combustion engine, said intake manifold including:

a liquid inlet opening for facing upwardly and for receiving liquid, a substantially flat, horizontal bearing surface surrounding said liquid inlet opening, a gasket positioned on said bearing surface, said gasket defining a central opening therein in alignment with said liquid inlet opening of said intake manifold, and said fill neck including:

a mounting body having a lower support platform with a footprint sized and shaped substantially the same as said gasket bearing against said gasket, a neck extending upwardly from said mounting body, a liquid passage formed through said mounting body and said neck and in communication with said liquid inlet opening of said intake manifold, said intake manifold further including a collar surrounding said bearing surface of a breadth greater than said gasket and said lower support platform and defining a reservoir with said gasket and said lower support platform for receiving and retaining liquid emitted from said gasket, whereby when liquid is emitted from said liquid inlet opening about said gasket, the emitted liquid will accumulate in said liquid reservoir before over flowing said collar.

2. The intake manifold and fill neck of claim 1 wherein:

said fill neck includes an outwardly facing surface configured to telescopically fin within said collar of said intake manifold.

3. The intake manifold and fill neck of claim 1, wherein said fill neck further includes:

a rim configured to extend laterally over said collar, said rim forming a coextensive surface with said collar.

4. The intake manifold and fill neck of claim 1, wherein said reservoir surrounds said gasket and said lower support platform of said mounting body of said fill neck.

5. An intake manifold and fill neck for an internal combustion engine, said intake manifold including:

a liquid inlet opening for facing upwardly and for receiving liquid, a bearing surface surrounding said liquid inlet opening, a collar surrounding said bearing surface, a gasket positioned on said bearing surface, said gasket defining a central opening therein in alignment with said liquid inlet opening of said intake manifold, and said fill neck including:

a mounting body bearing against said gasket, a neck extending upwardly from said mounting body, a liquid port formed through said mounting body and through said neck and in communication with said liquid inlet opening of said intake manifold, and a reservoir within the bounds of said collar about said mounting body, whereby when liquid is emitted from said liquid inlet opening about said gasket, the emitted liquid will accumulate in said liquid reservoir before over flowing said collar.

6. The intake manifold and fill neck of claim 5 wherein:

said mounting body of said fill neck is configured to telescopically fit within said collar of said intake manifold.

7. The intake manifold and fill neck of claim 6, said fill neck further including:

a rim configured to over hang said collar, said rim forming a co-extensive surface with said collar.

8. The intake manifold and fill neck of claim 6, wherein said collar is of a breadth greater than said gasket and said lower support platform, and said collar defines a reservoir with said bearing surface, said gasket and said lower support platform for receiving and retaining liquid emitted from said gasket.

9. An intake manifold and fill neck for an internal combustion engine, said intake manifold including:

a liquid inlet opening, a bearing surface surrounding said liquid inlet opening, a gasket positioned on said bearing surface and surrounding said inlet opening, a collar surrounding said gasket, said fill neck including:

a bearing platform mounted on said gasket inside said collar, and an overhanging rim extending over said collar and defining with said collar, said bearing platform and said bearing surface a reservoir for receiving liquid, whereby when liquid is emitted from said liquid inlet opening about said gasket, the liquid will accumulate in said liquid reservoir about said fill neck before over flowing said collar.

10. The intake manifold and fill neck of claim 9, wherein said fill neck includes an upwardly facing dome shaped mounting body.

11. A fill neck for mounting about the water fill opening of a water manifold of an internal combustion engine, comprising:

a mounting body having a substantially dome shaped upper surface and a lower support platform having a flat bottom engagement surface for mounting on the intake manifold, and a neck sloped upwardly from said dome shaped upper surface of said mounting body and defining with said mounting body a liquid passage through said fill neck.

* * * * *